US007780308B2

(12) United States Patent
Engel

(10) Patent No.: US 7,780,308 B2
(45) Date of Patent: Aug. 24, 2010

(54) RECESSED LIGHT

(75) Inventor: Hartmut S. Engel, Monrepos Strasse 7, Ludwigsburg (DE)

(73) Assignee: Hartmut S. Engel, Ludwigsburg (DE)

( * ) Notice: Subject to any disclaimer, the term of this patent is extended or adjusted under 35 U.S.C. 154(b) by 395 days.

(21) Appl. No.: 11/815,090

(22) PCT Filed: Jan. 23, 2006

(86) PCT No.: PCT/EP2006/000558

§ 371 (c)(1),
(2), (4) Date: Jul. 30, 2007

(87) PCT Pub. No.: WO2006/081961

PCT Pub. Date: Aug. 10, 2006

(65) Prior Publication Data

US 2008/0130291 A1 Jun. 5, 2008

(30) Foreign Application Priority Data

Feb. 2, 2005 (DE) ..... 10 2005 004 868

(51) Int. Cl.
*F21S 8/00* (2006.01)

(52) U.S. Cl. ..... 362/147; 362/222; 362/223; 362/297; 362/346; 362/364; 362/365

(58) Field of Classification Search ..... 362/147, 362/293, 297, 346, 364, 365, 263, 222, 223, 362/217.02–217.08, 298, 299, 300, 302, 362/304

See application file for complete search history.

(56) References Cited

U.S. PATENT DOCUMENTS 5,826,970 A * 10/1998 Keller et al. ..... 362/147
6,491,413 B1 * 12/2002 Benesohn ..... 362/294
2006/0245178 A1 11/2006 Engel

FOREIGN PATENT DOCUMENTS

DE 3249401 A1 10/1984

(Continued)

OTHER PUBLICATIONS

Manfred Schwarz, p. 6, Germany, 1978.

*Primary Examiner*—Sandra L O'Shea
*Assistant Examiner*—Mary Zettl
(74) *Attorney, Agent, or Firm*—Gifford, Krass, Sprinkle, Anderson & Citkowski, P.C.

(57) ABSTRACT

A built-in lamp includes a housing and a holder for fastening in a built-in surface, such as a room ceiling. The built-in lamp also includes a light source socket for holding a light source and a light source region and a direct light reflector. The direct light reflector has a direct light reflector opening which is disposed in the direction of illumination which defines a direct light exit region and which is surrounded at least reasonably by a diffused light exit region. The direct light reflector has a rear opening. The head reflector is disposed on the side of the light source region remote from the direct light exit region. The head reflector is separate from the direct light reflector and is shaped such that it directs at least a large portion of the light emitted from the light source region and incident on to it into the inner space of the direct light reflector.

26 Claims, 6 Drawing Sheets

FOREIGN PATENT DOCUMENTS

| | | | |
|---|---|---|---|
| DE | 3737324 | A1 | 5/1989 |
| DE | 4336023 | A1 | 4/1995 |
| DE | 4431136 | A1 | 3/1996 |
| DE | 4443916 | C1 | 5/1996 |
| DE | 29710475 | U1 | 8/1997 |
| DE | 20310475 | U1 | 11/2003 |
| DE | 20313905 | U1 | 1/2005 |
| DE | 10360945 | A1 | 7/2005 |
| DE | 10360947 | A1 | 7/2005 |
| EP | 0638764 | A2 | 2/1995 |
| EP | 0750159 | A | 12/1996 |
| EP | 1045195 | A2 | 4/2000 |
| JP | 11111018 | A | 4/1999 |

* cited by examiner

RECESSED LIGHT

CROSS REFERENCE TO RELATED APPLICATIONS

This application is a National Stage of International Application No. PCT/EP2006/000558, filed Jan. 23, 2006, and which claims the benefit of German Patent Application No. 10 2005 004 868.4, filed Feb. 2, 2005. The disclosures of the above application are incorporated herein by reference.

FIELD OF THE INVENTION

The invention relates to a built-in lamp comprising a housing and a holder for fastening in a build-in surface, in particular a room ceiling, a light source socket to hold a light source in a light source region and a direct light reflector having a direct light reflector opening which is disposed in the direction of illumination, which defines a direct light exit region and which is surrounded at least regionally by a diffuse light exit region, with the director light reflector having a rear opening.

BACKGROUND

Built-in lamps are known from the prior art in a variety of forms. "Dark-light lamps" are known, among others, in which the light source and the reflector are arranged with respect to one another such that the light source cannot be seen either directly or in reflection on the reflector from a specific angle of view and thus cannot develop any glare effect. This avoidance of a glare effect, however, also results in the ceiling region of a room illuminated in this manner remaining largely non-illuminated and in the relationship between the source of light and the illuminated region perceived as natural by a person being lost, since it cannot be recognized from which source of light the light originates.

SUMMARY

A built-in lamp of the initially named kind, which also has a diffuse light exit region in addition to a direct light exit region and which is described, for example, in the German patent application DE 103 60 947.4 avoids the mentioned disadvantages while providing a warm room climate from a technical lighting aspect since it is possible to work according to the "dark light principle" in the direct light exit region, with the non dazzling diffuse light exit region simultaneously providing the emission of scattered light whose luminance can be selected such that no glare effect occurs. A visible marking of the source of light is thus always ensured by the diffuse light exit region, which results in a room mood perceived as pleasing with a good light atmosphere despite the use of the dark light principle in the direct light exit region.

Built-in lamps such as are described in DE 103 60 947.4 are usually operated with compact fluorescent lamps, which has the consequence that no sufficient luminance can be achieved here for specific applications which require a particularly intense illumination.

Accordingly, an object of the present invention comprises further developing a built-in lamp in accordance with DE 103 60 974.4 such that increased luminance can be achieved, in particular on the use of spot-type light sources which can be made e.g. as high pressure halogen lamps.

This object is satisfied in accordance with the invention by the features of claim 1 and in particular in that a head reflector is provided on the side of the light source region remote from the direct light exit region, is separate from the direct light reflector and is shaped such that it directs at least a large portion of the light emitted from the light source region and incident on it into the inner space of the direct light reflector.

It is therefore achieved here in accordance with the invention while maintaining all advantages of a built-in lamp in accordance with DE 103 60 947.4 that a large portion of the light emitted by a light source is directed, on the one hand, directly and, on the other hand, via the additional head reflector into the inner space of the direct light reflector so that it can ultimately exit the direct light exit region of the built-in lamp. The amount of light entering into the inner space of the direct light reflector is thus considerably increased by the head reflector with respect to a built-in lamp in accordance with DE 103 60 947.4, which has the result that the luminance on the directly illuminated surfaces is also considerably increased. A more intense illumination with more pronounced contrasts and greater shadow formation is thus adopted, with these effects primarily being achieved by the additional head reflector provided in accordance with the invention.

It is furthermore of advantage in accordance with the invention that the head reflector ensures that a large portion of the light incident on it can reach the direct light exit region directly, i.e. without any further reflection at the inner surfaces of the direct light reflector, such that the areas to be illuminated are ultimately illuminated to a substantial extent directly via the head reflector. This has the result that the reflecting inner surfaces of the direct light reflector appear less bright, whereby the glare effect due to the inner surfaces of the direct light reflector is additionally reduced.

With a skillful arrangement of the head reflector, which will be explained specifically in the following, it can simultaneously be achieved that a still sufficiently large portion of light reaches the diffuse light exit region so that the latter can signal the position of the built-in lamp in a non dazzling manner.

Overall, in accordance with the invention, an exceptionally good, uniform light distribution results over the whole surface to be illuminated via the direct light exit region with a nevertheless pleasant room mood and a good light atmosphere. This is achieved by the intense illumination via the direct light exit region and the emission of an additional amount of scattered light via the diffuse light exit region.

The advantages in accordance with the invention can be realized in a particularly good manner when the head reflector has a concave shape opening toward the light source region. The head reflector can specifically be made as a parabolic reflector, for example.

Various possibilities exist in accordance with the invention with respect to the positioning of the light source region, the direct light reflector and the head reflector. It is, however, preferred for the light source region to be arranged on the side of the rear opening of the direct light reflector remote from the direct light exit region so that the light source region ultimately comes to lie between the rear opening of the direct light reflector and the head reflector. In this case, light emitted from the light source region reaches the head reflector and is directed from there via the rear opening of the direct light reflector into its inner space.

The head reflector is generally made as small as possible in accordance with the invention. It is specifically possible to select the extent of the head reflector to be smaller in a direction extending parallel to the plane of the direct light exit region than the diameter of the rear opening of the direct light reflector. However, the head reflector should simultaneously engage at least to the largest possible extent over the light source present in the light source region so that it is of advantage for the extent of the head reflector to be larger in a direction extending parallel to the plane of the direct light exit region than the longitudinal extent of the light source region or of the light source in a direction likewise extending parallel to the plane of the direct light exit region.

It is preferred for the light source region to be arranged at least substantially inside the head reflector since it can be achieved in this manner that the light emitted by the light source is directly incident on the head reflector to a very large extent and can reach into the inner space of the direct light reflector from there.

It is advantageous for the direct light exit region and the diffuse light exit region to be acted on by a common light source, since no separate light source has to be provided for the diffuse light exit region in this manner.

An additional reflector can be provided in a housing region surrounding the direct light reflector and/or the head reflector and is in particular formed by the inner surfaces of the housing. The diffuse light exit region is then primarily acted on via this additional reflector; however, the direct light exit region can also be acted on to a lesser extent via the additional reflector. With such an arrangement, the light source radiates direct light, on the one hand, directly via the direct light reflector and indirectly via the head reflector into the actual direction of illumination and, however, on the other hand, also to the additional reflector which directs the light incident on it at least partly to the diffuse light exit region. The additional reflector can reflect either in a specularly reflecting manner or in a diffuse manner and a conversion of directly reflected light into scattered light should take place in the region of the diffuse light exit region in the first-named case.

The light source socket provided in accordance with the invention can in particular be configured for the holding of a halogen lamp, of a high pressure halogen lamp or of another spot-like source of light since a particularly high intensity of illumination or a particularly high luminous flux can be achieved using a light source of this type.

It is particularly advantageous for a diffuser plate to be arranged on the side of the light source region remote from the head reflector. This diffuser plate preferably extends parallel to the plane of the direct light exit region. It can in particular be arranged between the light source region and the rear opening of the direct light reflector.

The extent of the diffuser plate in a direction extending parallel to the plane of the direct light exit region is advantageously approximately just as large as the corresponding extent of the head reflector.

The diffuser plate is preferably arranged spaced apart both from the head reflector and from the rear opening of the direct light reflector, with these spacings being able to amount to between 0.5 cm and 3 cm. It is hereby achieved that a proportion of light quantity which is admittedly comparatively small, but still large enough, does not reach into the inner space of the direct light reflector, but can rather be directed to the diffuse light exit region.

The diffuser plate provided in accordance with the invention has the effect that the light reflected by the head reflector in the direction of the inner space of the direct light reflector has to pass through the diffuser plate. That light must furthermore also pass through the diffuser plate which reaches into the inner space of the direct light reflector directly and without reflection at the head reflector. This has the result that the light passing through the diffuser plate is distributed particularly uniformly over the direct light exit region and thus ultimately provides a uniform illumination of the areas acted on by light while reducing the luminance of the light source. At the same time, the diffuser plate can ensure due to its light conducting and/or reflecting properties that light also reaches the additional reflector which has already been mentioned above and which is then ultimately responsible for an action on the diffuse light exit region.

It is particularly preferred for the diffuser plate to be made as a UV filter. Since ultimately all of the light exiting the direct light exit region must first pass through the diffuser plate, the diffuser plate already provides sufficient UV filtering so that it is no longer necessary to make a cover plate provided in the direct light exit region as a UV filter. The diffuser plate as a rule has smaller dimensions than a cover plate in the direct light exit region. The total area of the UV filter to be provided in the built-in lamp in accordance with the invention can therefore be considerably reduced by a diffuser plate made as a UV filter so that an economic advantage is hereby achieved.

Alternatively or additionally, the diffuser plate can also be made as a color filter so that colored light exits the direct light exit region—unlike the diffuse light exit region.

The light source socket of a built-in lamp in accordance with the invention can in particular be pivotably supported together with a diffuser plate holder. In this case, the light source socket together with the light source, and optionally the diffuser plate together with the diffuser plate holder, can be pivoted, for example, from a substantially horizontal position into a position in which the light source is particularly easily accessible for the purpose of changing. The maximum pivot angle on such a pivot movement can amount, for example, to between 45° and 90°, in particular to between 50° and 70°. With a pivot angle of approximately 60°, the light source can be changed particularly comfortably.

The light source socket and in particular also the diffuser plate holder can be biased into their operating position by means of a spring element. The light source and the diffuser plate as a rule extend horizontally in the operating position. On a change of the light source or also of the diffuser plate, only the already described pivot movement then has to take place against the comparatively small force of the spring element, whereupon a change of the light source is possible without problem in this pivoted position. After a completed change of the light source, the light source socket and optionally the diffuser plate holder are automatically pivoted back into their correct operating position again by the spring element so that operating error is practically precluded here.

The light source socket and the diffuser plate holder can be provided in a common holding element. In this case, the common pivot movement of the light source socket and the diffuser plate holder can be effected particularly simply in that the named holding element is made to be pivotable. In this case, the light source socket and the diffuser plate holder are arranged rigidly in the holding element.

A particularly good accessibility of the light source, which is in particular pivotable, is produced when the direct light reflector is also held pivotably in the housing. In this case, the direct light reflector can be pivoted away first so that the light source and optionally the diffuser plate is easily accessible for a further pivot movement.

The diffuse light exit region is—as already mentioned—not acted on directly in accordance with the invention via the head reflector, but only indirectly via the additional reflector and optionally via the diffuser plate. A particularly good illumination of the diffuse light exit region is produced when the direct light reflector is made to be specularly reflecting or diffusely reflecting on its outer side since in this case light can reach the diffuse light exit region particularly easily via the additional reflector and the outer side of the direct light reflector.

The housing of the built-in lamp in accordance with the invention can also be in particular at least largely closed in a dust tight manner in the region of the diffuse exit region, and preferably also in the region of the direct light exit region, by a transparent cover plate. It is not necessary in this connection to make this plate as a UV filter when the diffuser plate already acts as a UV filter.

The cover plate can also only be provided in the region of the diffuse light exit region so that the direct light exit region is open in the direction of illumination. It is preferred in this case for the cover plate to have the light scattering properties desired in the diffuse light exit region and accordingly to be made of a suitable material which is not completely transparent.

Further preferred embodiments of the invention are set forth in the dependent claims.

BRIEF DESCRIPTION OF THE DRAWINGS

The invention will be described in the following with reference to an embodiment and to the drawings; there are shown in these.

DETAILED DESCRIPTION

Figure 1:
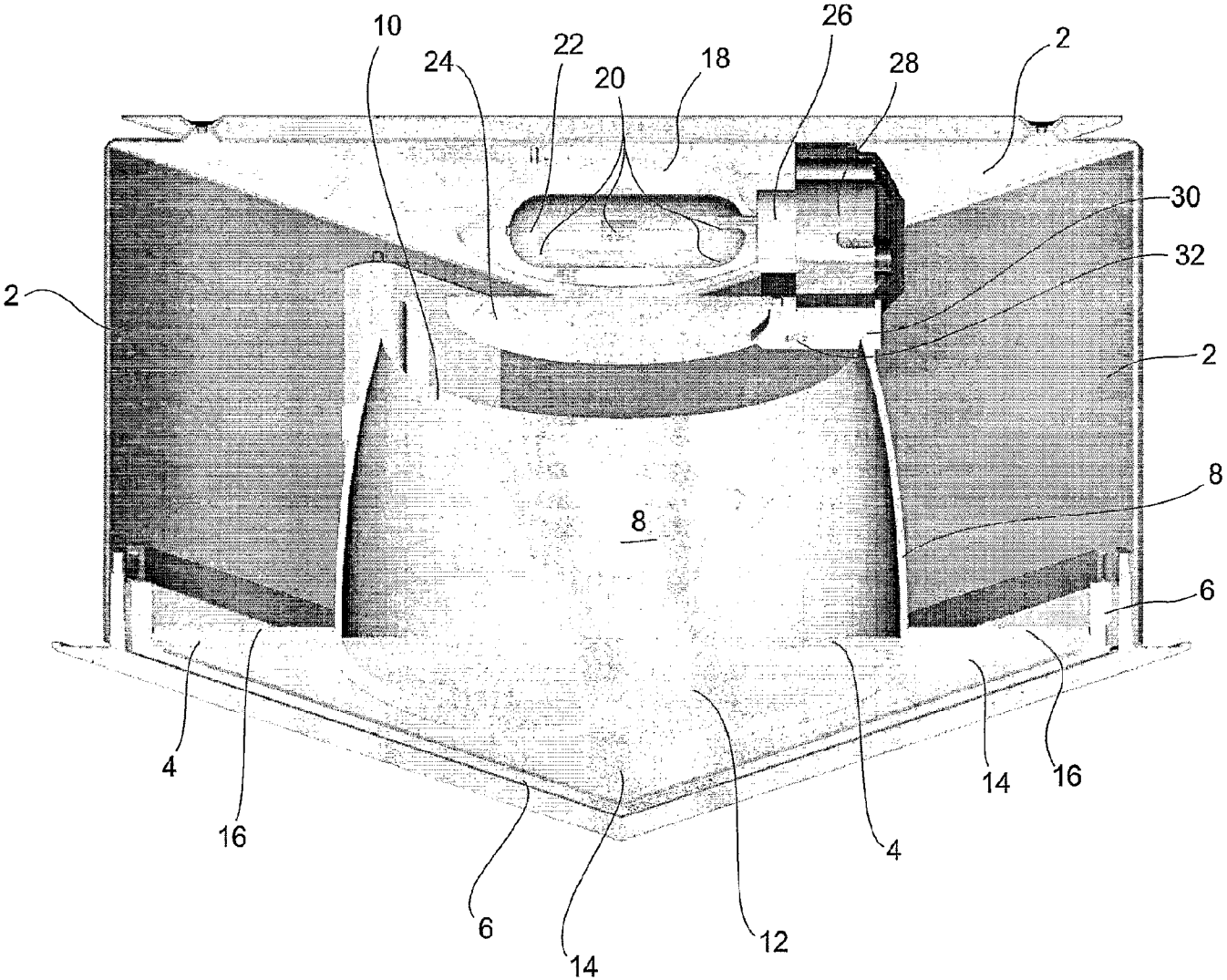
FIG. 1 a diagonal section through a perspective view of a built-in lamp in accordance with the invention in which all the elements of the built-in lamp are in their respective operating positions.

The built-in lamp in accordance with the invention in accordance with FIGS. 1 to 6 has a housing 2 which is open at one side and which is closed in an at least largely dust tight manner in the region of its open side disposed in the direction of illumination by a square cover plate 4. The cover plate 4 is fastened in a frame 6 pivotably attached to the housing.

A direct light reflector 8 which is substantially dome shaped and has a rear opening 10 is connected to the cover plate 4 in a suitable manner. That region of the cover plate 4 which closes the direct light reflector 8 in the direction of illumination forms a circular direct light exit region 12 which is surrounded by a diffuse light exit region 14. The diffuse light exit region 14 is bounded at the inner side by a circle line corresponding to the direct light reflector 8 and at the outer side by a square line corresponding to the frame 6. A diffusion plate 16 can in particular extend parallel to the cover plate 4 in the diffuse light exit region 14 and ensures that the light incident on the diffuse light exit region 14 actually exits the built-in lamp as scattered light. In this case, a collar of the direct light reflector 8 disposed in the direction of illumination and facing outwardly can be clamped between the cover plate 4 and the diffusion plate 16 so that the direct light reflector 8 is fixed in the region of the cover plate 4 in this manner.

Alternatively, a cover plate could also be used which only terminates the diffuse light exit region 14 and which has a circular hole in the region of the direct light exit region 12.

The outer side of the direct light reflector 8 and the inner side of the housing 2 are made as reflecting or as diffusely reflecting.

A head reflector 18 in accordance with the invention, which has a parabolic shape, is located on that side of the rear opening 10 of the direct light reflector 8 which is remote from the direct light exit region 12. The light source region 20 in accordance with the invention, in which a light source 22 made as a high pressure halogen lamp comes to lie in its operating position (FIG. 1 and FIG. 3), is located partly inside the head reflector 18, partly between this head reflector 18 and the rear opening 10.

A substantially circular diffuser plate 24 is located between the rear opening 10 of the direct light reflector 8 and the light source 22 and its diameter approximately corresponds to the diameter of the head reflector 8 and which can correspondingly ensure that the light radiated by the light source 22 into the inner space of the direct light reflector 8 directly or indirectly via the head reflector 18 has to pass through the diffuser plate 24 so that a luminance is adopted which is constant over the whole area of the diffuser plate 24 and reduced with respect to the light source 22, whereby ultimately a particularly uniform illumination of the inner region of the direct light reflector 8 results.

The light source 22 is held in a light source socket 26 which is in turn received in a holding element 28. The holding element 28 forms, together with a holding plate 30 and two screws 32, a holder for the diffuser plate 24.

A U-shaped holding web 34 is shaped to the rear side of the head reflector 18 and the head reflector 18 can be fixedly connected to the base of the housing 2 via it. The U-shaped holding web 34 has two conically outwardly converging cut-outs 36 which are likewise of U shape and into which two conical holding spigots 38 can be hung which are shaped to the holding element 28 at the side.

Figure 2:
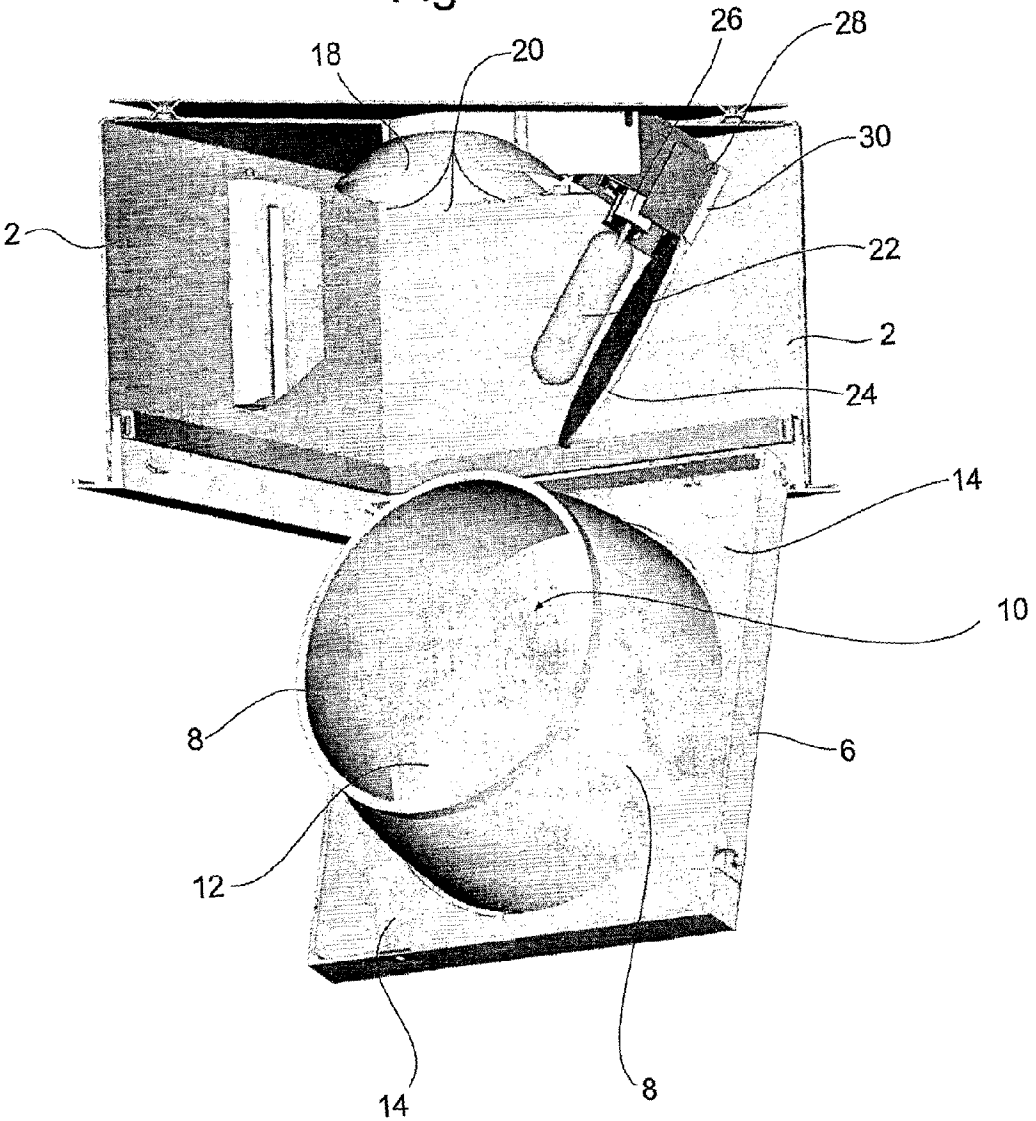
FIG. 2 a diagonal section through a perspective view of a built-in lamp in accordance with FIG. 1 in which the direct light reflector, the light source and the diffuser plate are in a position pivoted with respect to FIG. 1 in which a change of light source is possible, with the direct light reflector and the diffuse light exit region being shown in a non-sectioned manner in this illustration in contrast to FIG. 1.
Figure 3:
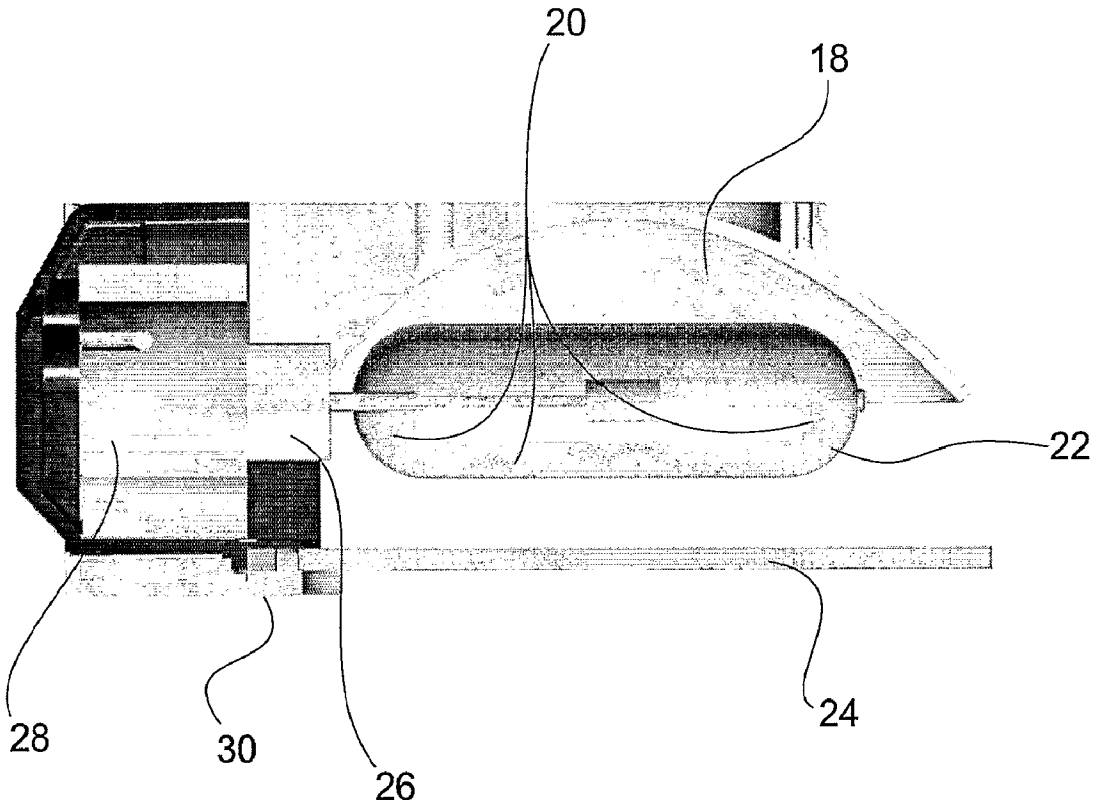
FIG. 3 the unit of head reflector, light source and diffuser plate used in a lamp in accordance with FIGS. 1 and 2 in their respective operating positions (sectioned side view)
Figure 4:
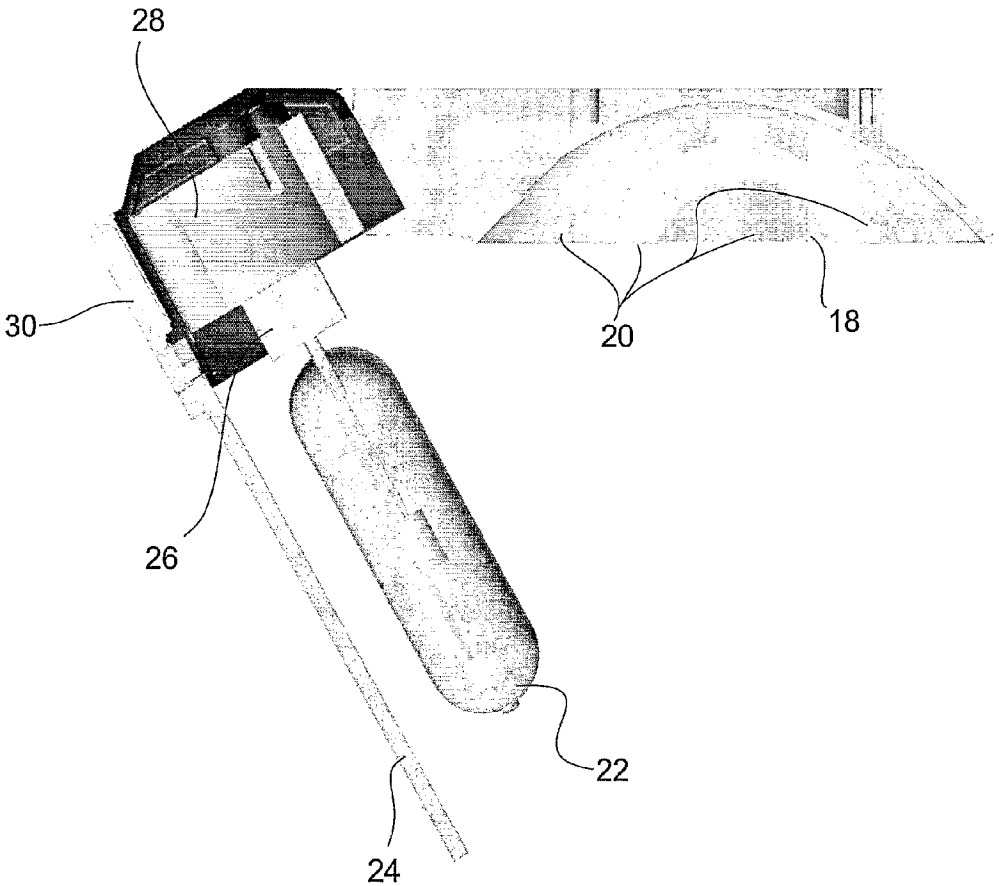
FIG. 4 a representation corresponding to FIG. 3 in which a light source and a diffuser plate are in a pivoted position in which a change of the light source is possible.
Figure 5:
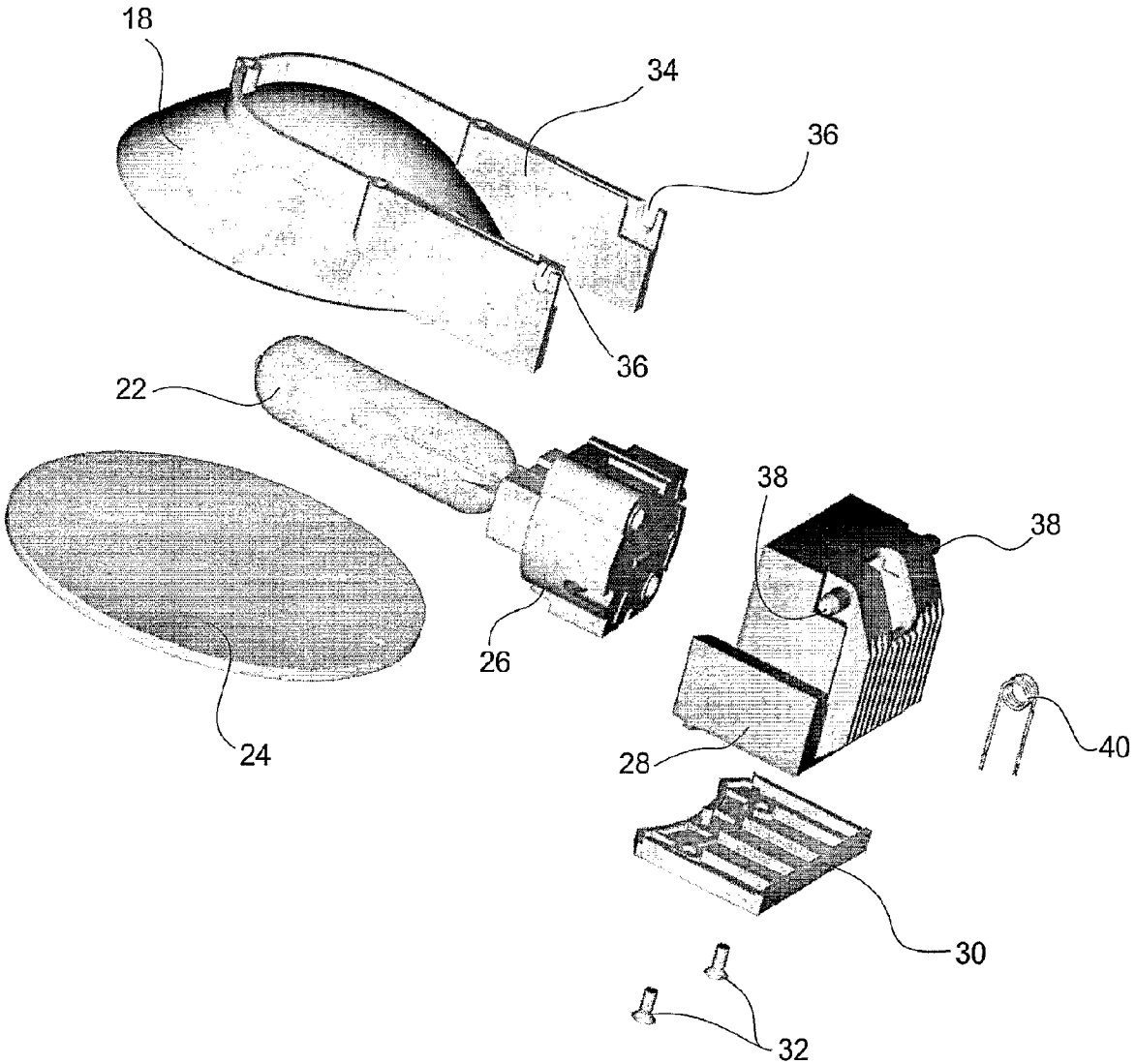
FIG. 5 an exploded drawing of the unit shown in FIGS. 3 and 4 from a first perspective.
Figure 6:
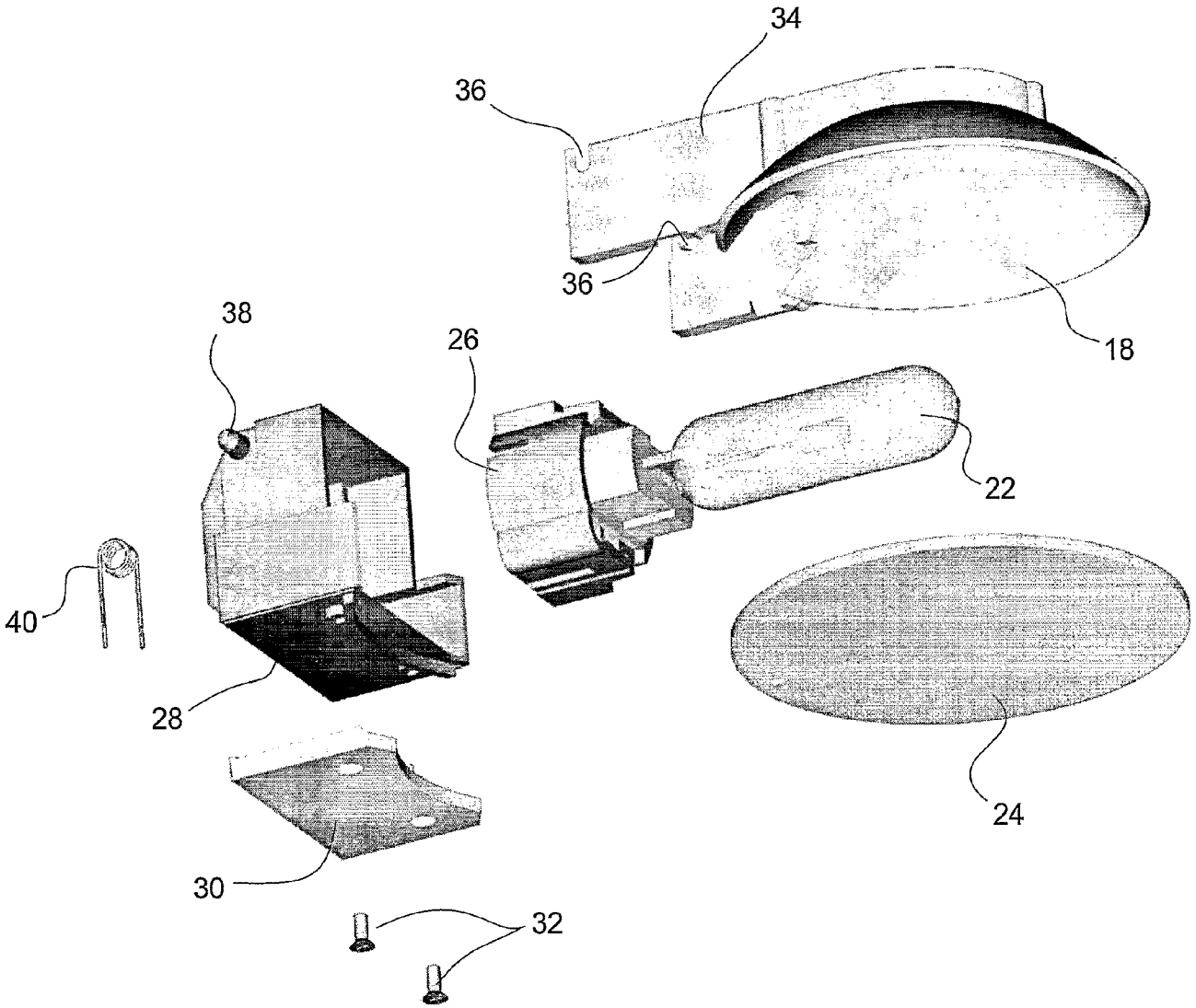
FIG. 6 an exploded drawing of the unit shown in FIGS. 3 and 4 from a second perspective.

When the holding spigots 38 are hung into the cut-outs 36, an interposed spring element 40 ensures that the holding element 28 pivotable with respect to the head reflector 18 is held in its horizontal operating position in accordance with FIGS. 1 and 3. The holding element 28 can, for example, be pivoted against the force of the spring 40 by a gripping of the diffuser plate 24 after an opening of the frame 6 into a position such as is shown in FIGS. 2 and 4. In this position, the light source 22 is easily accessible for the purpose of changing.

The cooperation in a technical light connection between the head reflector 18, the light source 20, the diffuser plate 24, the inner housing side 2 and the inner side and the outer side of the direct light reflector 8 has already been explained in detail above. The head reflector 18 together with the diffuser plate 24 ultimately ensures an intense illumination via the direct light exit region 12. Since the diffuser plate 24 is arranged spaced apart from the head reflector 18 and also from the rear opening 10 of the direct light reflector 8, a proportion of the quantity of light which is admittedly comparatively small, but sufficiently large, does not reach into the inner space of the direct light reflector 8 via the intermediate spaces produced by the said spacings and also via the light conductive properties of the diffuser plate 24, but reaches via the reflecting or remitting inner sides of the housing 2 as well as via the likewise reflecting or remitting outer side of the direct light reflector 8 the diffuse light exit region 14 from which this light portion then exits as scattered light from the cover plate 4.

REFERENCE NUMERAL LIST

2 housing
4 cover plate
6 frame
8 direct light reflector
10 rear opening
12 direct light exit region
14 diffuse light exit region
16 diffusion plate
18 head reflector
20 light source region
22 light source
24 diffuser plate
26 light source socket
28 holding element
30 holding plate
32 screws
34 holding web
36 cut-outs
38 holding spigot
40 spring element

What is claimed is:

1. A built-in lamp comprising a housing (2) and a holder for fastening in a build-in surface, a light source socket (26) for holding a light source (22) in a light source region (20) and a direct light reflector (8) having a direct light reflector opening which is disposed in the direction of illumination, which defines a direct light exit region (12) and which is surrounded at least regionally by a diffuse light exit region (14), with the direct light reflector (8) having a rear opening (10), characterized in that a head reflector (18) is disposed on the side of the light source region (20) remote from the direct light exit region (12), is separate from the direct light reflector (8) and is shaped such that it directs at least a large portion of the light emitted from the light source region (20) and incident onto it into the inner space of the direct light reflector (8), the head reflector having an opening located above the rear opening of the direct light reflector plate (24) is arranged on the side of the light source region (20) remote from the head reflector (18), and wherein the diffuser plate (24) is arranged between and spaced apart both from the opening of the head reflector (18) and from the rear opening (10) of the direct light reflector (8), with these spacings amounting to between 0.5 cm and 3 cm.

2. A built-in lamp in accordance with claim 1, characterized in that the head reflector (18) has a concave shape opening toward the light source region (20).

3. A built-in lamp in accordance with claim 2, characterized in that the head reflector (18) is made as a parabolic reflector.

4. A built-in lamp in accordance with claim 1, characterized in that the light source region (20) is arranged on the side of the rear opening (10) of the direct light reflector (8) remote from the direct light exit region (12) so that the light source region (20) is disposed between the rear opening (10) of the direct light reflector (8) and the head reflector (18).

5. A built-in lamp in accordance with claim 1, characterized in that the extent of the head reflector (18) is smaller in a direction extending parallel to the plane of the direct light exit region (12) than the diameter of the rear opening (10) of the direct light reflector (8).

6. A built-in lamp in accordance with claim 1, characterized in that the extent of the head reflector (18) is larger in a direction extending parallel to the plane of the direct light exit region (12) than the longitudinal extent of the light source region (20) or of the light source (22) in a direction likewise extending parallel to the plane of the direct light exit region (12).

7. A built-in lamp in accordance with claim 1, characterized in that the light source region (20) is arranged at least substantially inside the head reflector (18).

8. A built-in lamp in accordance with claim 1, characterized in that the light source socket (26) is configured for the holding of a halogen lamp, of a high pressure halogen lamps (22) or of another spot-like source of light.

9. A built-in lamp in accordance with claim 8, characterized in that the diffuser plate (24) extends parallel to the plane of the direct light exit region (12).

10. A built-in lamp in accordance with claim 9, characterized in that the diffuser plate (24) is arranged between the light source region (20) and the rear opening (10) of the direct light reflector (8).

11. A built-in lamp in accordance with claim 10, characterized in that the diffuser plate (24) is arranged spaced apart both from the head reflector (18) and from the rear opening (10) of the direct light reflector (8), with these spacings amounting to between 0.5 cm and 3 cm.

12. A built-in lamp in accordance with claim 9, characterized in that the extent of the diffuser plate (24) is approximately equally as large in a direction extending parallel to the plane of the direct light exit region (12) as the corresponding extent of the head reflector (18).

13. A built-in lamp in accordance with claim 9, characterized in that the diffuser plate (24) is made as a UV filter and/or a color filter.

14. A built-in lamp in accordance with claim 9, characterized in that the diffuser plate (24) is arranged between the light source region (20) and the rear opening (10) of the direct light reflector (8).

15. A built-in lamp in accordance with claim 9, characterized in that the diffuser plate (24) is arranged spaced apart both from the head reflector (18) and from the rear opening (10) of the direct light reflector (8), with these spacings amounting to between 0.5 cm and 3 cm.

16. A built-in lamp in accordance with claim 9, characterized in that the diffuser plate (24) is made as a UV filter and/or a color filter.

17. A built-in lamp in accordance with claim 1, characterized in that the light source socket (26) is pivotably supported.

18. A built-in lamp in accordance with claim 1, characterized in that the maximum pivot angle amounts to between 45° and 90° , in particular to between 50° and 70 °.

19. A built-in lamp in accordance with claim 1, characterized in that the light source socket (26) and in particular also the diffuser plate holder (28, 30, 32) are biased into their operating positions by means of a spring element (40).

20. A built-in lamp in accordance with claim 1, characterized in that the light source socket (26) and the diffuser plate holder (28, 30, 32) are provided in a common holding element (28).

21. A built-in lamp in accordance with claim 1, characterized in that the direct light reflector (8) is held pivotably in the housing (2).

22. A built-in lamp in accordance with claim 1, characterized in that the direct light exit region (12) and the diffuse light exit region (14) can be acted on by a common light source (22).

23. A built-in lamp in accordance with claim 1, characterized in that a separate reflector is provided in a housing region surrounding the direct light reflector (8) and/or the head reflector (18).

24. A built-in lamp in accordance with claim 23, characterized in that the diffuse light exit region (14) can only be acted on by the light source (22) indirectly via the additional reflector (2) and/or via the diffuser plate (24).

25. A built-in lamp in accordance with claim 1, characterized in that the direct light reflector (8) is made specularly reflecting or diffusely reflecting on its outer side.

26. A built-in lamp in accordance with claim 1, characterized in that the housing (2) is in particular at least largely closed in a dust tight manner by a transparent plate (4) in the region of the diffuse light exit region (14) and preferably also in the region of the direct light exit region (12).

* * * * *